US006725525B1

(12) United States Patent
Shikama et al.

(10) Patent No.: US 6,725,525 B1
(45) Date of Patent: Apr. 27, 2004

(54) METHOD OF MANUFACTURING AN INDUCTOR

(75) Inventors: Takashi Shikama, Yokaichi (JP); Iwao Fukutani, Shiga-ken (JP); Junichi Hamatani, Shiga-ken (JP); Kenichi Saito, Fukui-ken (JP); Hisato Oshima, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/638,038

(22) Filed: Aug. 12, 2000

(30) Foreign Application Priority Data

Aug. 13, 1999 (JP) ..... 11-229034

(51) Int. Cl.[7] ..... H01F 7/06

(52) U.S. Cl. ..... 29/602.1; 29/605; 29/606; 29/607; 205/205; 205/208; 336/192; 336/83; 336/206

(58) Field of Search ..... 29/602.1, 605, 29/606, 607, 608; 205/122, 170, 205, 208; 336/192, 83, 206; 438/665

(56) References Cited

U.S. PATENT DOCUMENTS 3,969,195 A * 7/1976 Dotzer et al. ..... 205/208
5,544,410 A * 8/1996 Kato et al. ..... 29/605
5,821,843 A 10/1998 Mamada et al.

FOREIGN PATENT DOCUMENTS

| | | | |
|---|---|---|---|
| EP | 0845792 | 6/1998 | |
| JP | 52-97336 | 8/1977 | |
| JP | 58-91194 | * 5/1983 | ..... 205/208 |
| JP | 60-164314 | * 8/1985 | ..... 29/602.1 |
| JP | 60-255993 | * 12/1985 | ..... 205/210 |
| JP | 5-304035 | 11/1993 | |
| JP | 8-191022 | 9/1994 | |
| JP | 08191022 | 7/1996 | |
| JP | 8-306541 | 11/1996 | |
| JP | 11-186040 | 11/1999 | |

* cited by examiner

*Primary Examiner*—A. Dexter Tugbang
(74) *Attorney, Agent, or Firm*—Keating & Bennett, LLP

(57) ABSTRACT

A method of manufacturing an inductor includes the step of molding a magnetic material formed by kneading a magnetic material and a resin to form a magnetic material compact body in which the internal conductor is partially exposed from the external surface thereof. Then the surface of the magnetic material compact body is plated to form the external electrodes including a plated metal film and connected to the internal conductor. The surface of the magnetic material compact body is roughened, and then the external electrodes are formed via plating.

15 Claims, 4 Drawing Sheets

METHOD OF MANUFACTURING AN INDUCTOR

BACKGROUND OF THE INVENTION

1. Field of the Invention

The present invention relates to an inductor and a method of producing such an inductor, and more particularly, the present invention relates to an inductor having a conductor (internal conductor) functioning as an inductance element that is located within a magnetic material produced by kneading a magnetic powder and a resin, and a method of producing the inductor.

2. Description of the Related Art

As shown in FIG. 7, a surface-mount inductor including a magnetic material compact body 53 that is produced by molding a magnetic material 51 obtained by kneading a magnetic powder and a resin into a mold in which a coil (internal conductor) 52 functioning as an inductance element is buried in the magnetic material 51, with both ends 52*a* and 52*b* of the coil 52 exposed at both end surfaces of the magnetic material compact body 53, and a pair of external electrodes 54*a* and 54*b* provided at both end surfaces of the magnetic material compact body 53.

This inductor can be produced by molding the magnetic material 51 obtained by kneading a magnetic powder and a resin to produce the magnetic material compact body 53, and then providing the external electrodes 54*a* and 54*b* on the magnetic material compact body 53. Thus, the step of firing the inductor at high temperature is not necessary, which is required for conventional ceramic inductors including magnetic ceramic material. Therefore, the manufacturing cost of producing the inductor is decreased.

However, in forming the external electrodes of the above-described inductor by a method including the steps of coating conductive paste and baking it, like in ceramic inductors, the resin that constitutes the magnetic material compact body decomposes in response to the heat applied during baking of the conductive paste. Under actual conditions, it is very difficult to apply the conventional method using conductive paste without modification.

Therefore, a conventional inductor is shown in FIG. 8, in which metal caps 55*a* and 55*b* are mounted as external electrodes to both ends of the magnetic material compact body so as to be connected to both ends of the coil 52. However, the metal caps are expensive and require the step of mounting the metal caps, thereby increasing production cost.

In other conceivable methods of forming the external electrodes using conductive paste, special conductive paste that can be baked at low temperature is used, or a resin having excellent heat resistance is used as the resin that constitutes the magnetic material compact body. However, both of these methods are problematic because they produce inductors with diminished and inferior properties, and decrease the ease and degree of freedom of the manufacturing process.

SUMMARY OF THE INVENTION

To overcome the above-described problems, preferred embodiments of the present invention provide an inductor in which external electrodes are efficiently provided without using metal caps or baking conductive paste, and which has high reliability of connection between the external electrodes and an internal conductor, and desired properties. Preferred embodiments of the present invention also provide a method of producing such a novel inductor.

A method of producing an inductor according to preferred embodiments of the present invention includes the steps of molding a magnetic material obtained by kneading a magnetic powder and a resin into a desired shape in which a conductor (internal conductor) functioning as an inductance element is buried to form a magnetic material compact body in which the internal conductor is partially exposed at a surface thereof, and plating the surface of the magnetic material compact body to form external electrodes including a metallic film electrically connected to the portions of the internal conductor which are exposed on the surface of the magnetic material compact body.

The method of producing an inductor according to preferred embodiments of the present invention includes molding the magnetic material obtained by kneading the magnetic powder and the resin into the desired shape to form the magnetic material compact body in which the internal conductor is partially exposed at a surface thereof, and plating the surface to form the external electrodes so that the external electrodes are electrically connected to the internal conductor. Thus, the method according to preferred embodiments of the present invention eliminates the necessity of a heat-treatment step for firing in the step of forming the magnetic material compact body, baking conductive paste in the step of forming the external electrodes, while avoiding decomposition or transformation of the magnetic material in the heat treatment step, thereby permitting the efficient production of an inductor having desired properties. Further, there is also no need for equipment such as a heat treatment furnace, or other similar equipment, and thermal energy used for heat treatment, thereby reducing production costs.

In preferred embodiments of the present invention, the step of molding the magnetic material into the predetermined shape to form the magnetic material compact body in which the internal conductor is partially exposed at a surface thereof is applicable not only where the magnetic material is molded to form the magnetic material compact body including the internal conductor partially exposed at the surface thereof, but also in methods including the step of exposing the internal conductor, such as where the magnetic material compact body is cut and ground to partially expose the internal conductor at the surface after the magnetic material is molded.

The method of producing an inductor according to preferred embodiments of the present invention further includes roughening portions of the surface of the magnetic material compact, on which plated metal films are formed by plating, before such plating is performed.

By performing plating after roughening the portions of the surface of the magnetic material compact body which are to be plated, the strength of adhesion of the plated metal film to the magnetic material compact body is greatly improved, thus significantly improving reliability.

The method of producing an inductor according to preferred embodiments of the present invention includes exposing both ends of the internal conductor at both end surfaces of the magnetic material compact body, roughening at least both end surfaces thereof, and plating at least portions of the roughened surfaces to form the external electrodes.

In the method including exposing both ends of the internal conductor at both end surfaces of the magnetic material compact body, roughening at least both end surfaces thereof, and then plating at least portions' of the roughened surfaces to form the external electrodes, the external electrodes are provided on both end surfaces of the magnetic material compact body to allow the efficient production of a chip-type inductor having excellent adaptability for surface mounting, thereby increasing the effectiveness of the present invention.

In the method of producing an inductor according to preferred embodiments of the present invention, with the internal conductor including a coiled metal conductor (coil), both end surfaces of the magnetic material compact body are roughened to expose ⅓ to 1 turn of the coil so that the coil partially projects from both end surfaces of the magnetic material compact, and then at least portions of the roughened surfaces are plated to form the external electrodes.

In the method including roughening the surface to expose about ⅓ to 1 turn of the internal conductor, which includes a coiled metal conductor (coil), so that the coil partially projects from both end surfaces of the magnetic material compact, and then forming the external electrodes by plating, a sufficient area of contact between the coil and the external electrodes is ensured, thus significantly improving reliability of electrical contact between the coil and the external electrodes.

Although a coil coated with an insulating coating material is generally used as the coil, the insulating coating material of the coil can be removed by surface roughening. Furthermore, the coil is exposed so as to partially project from both end surfaces of the magnetic material compact, thereby not only increasing the area of contact with the external electrodes, but also increasing the strength of adhesion between the external electrodes and the magnetic material compact body due to the unevenness formed on the surfaces of the magnetic material compact body on which the external electrodes are provided. This further improves the reliability of connection with the external electrodes.

The reason for exposing about ⅓ to 1 turn of the coil from the end surfaces of the magnetic material compact body is that exposure of at least about ⅓ turn of the coil causes sufficient connection reliability, and exposure of more than about 1 turn of the coil causes an undesirable short circuit in the exposed coil.

In the exposed portions of the coil, the coil is preferably exposed so as to project from both end surfaces of the magnetic material compact body by about ½ of the diameter of a wire constituting the coil.

The method of producing an inductor according to another preferred embodiment of the present invention includes roughening a region extending from either end surface of the magnetic material compact body to a portion of the peripheral surface (a portion at either end of the peripheral surface), and then forming the external electrode by plating so that the external electrode extends from the either end surface of the magnetic material compact body to the portion of the peripheral surface thereof.

In the method including roughening the region extending from either end surface of the magnetic material compact body to the portion of the peripheral surface thereof, and then forming the external electrode by plating so that the external electrode extends from the either end surface of the magnetic material compact body to the portion of the peripheral surface thereof, for example, in mounting by reflow soldering, the mounting workability is substantially improved, and the reliability of connection (mounting) is also substantially improved.

In the method of producing an inductor according to another preferred embodiment of the present invention, the surface of the magnetic material compact body is roughened by the medium spraying method of spraying a surface roughening medium (powder and granules).

In the method of roughening the surface of the magnetic material compact body by the method of spraying the surface roughening medium (powder and granules), for example, a dry blast method (sand blast method) in which a-medium such as an alumina powder, a silica powder or other suitable material is sprayed together with air to grind the surface of the magnetic material compact, or a wet blast method in which an alumina powder, a silica powder, or other suitable material is sprayed together with a liquid such as water to grind the surface of the magnetic material compact, the surface is efficiently roughened in a short time, thus further improving the effectiveness of the present invention.

In preferred embodiments of the present invention, surface roughening can be performed by another method, for example, which includes the steps of placing a plurality of magnetic material compacts in a barrel, and stirring the compacts. In this case, however, the time required for surface roughening is increased, thereby reducing the production efficiency as compared with the above medium spraying method.

In the method of producing an inductor of according to a preferred embodiment of the present invention, the external electrodes have a multilayer structure including a plurality of plated metal films.

In various preferred embodiments of the present invention, the structure and type of the plated metal film that constitutes the external electrodes are not particularly limited, and the external electrodes may also have a single layer structure. However, in order to ensure the solderability of the external electrodes and reliability of electric connection, a multilayer structure is preferably used. For example, an Ag plated film or Ni plated film is provided as a base electrode, and a Sn plated film or solder plated film is provided on the base electrode to provide an inductor including external electrodes having both excellent reliability of electrical connection and solderability.

An inductor according to preferred embodiments of the present invention is produced by the above-described method, and includes a magnetic material compact body formed by kneading a-magnetic powder and a resin, and molding into a desired shape, a conductor (internal conductor) buried in the magnetic material compact body and functioning as an inductance element, and external electrodes provided on the surface of the magnetic material compact body and including plated metal films electrically connected to the internal conductor.

The inductor produced by the above-described inductor producing method has the above construction, exhibits high reliability of connection between the external electrodes and the internal conductor, and is efficiently produced at low cost.

Other features, elements, steps, characteristics and advantage of the present invention will become more apparent from the following detailed description of preferred embodiments thereof with reference to the attached drawings.

DETAILED DESCRIPTION OF PREFERRED EMBODIMENTS

The characteristics of the present invention will be described in further detail below with reference to preferred embodiments thereof.

Figure 4:
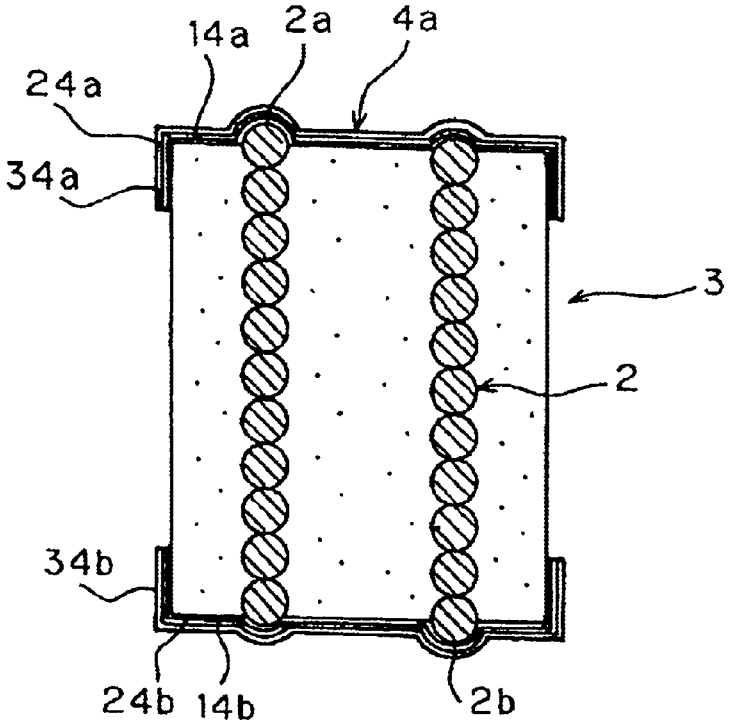
FIG. 4 is a sectional view showing the structure of an inductor produced by an inductor producing method in accordance with a preferred embodiment of the present invention.
Figure 5:
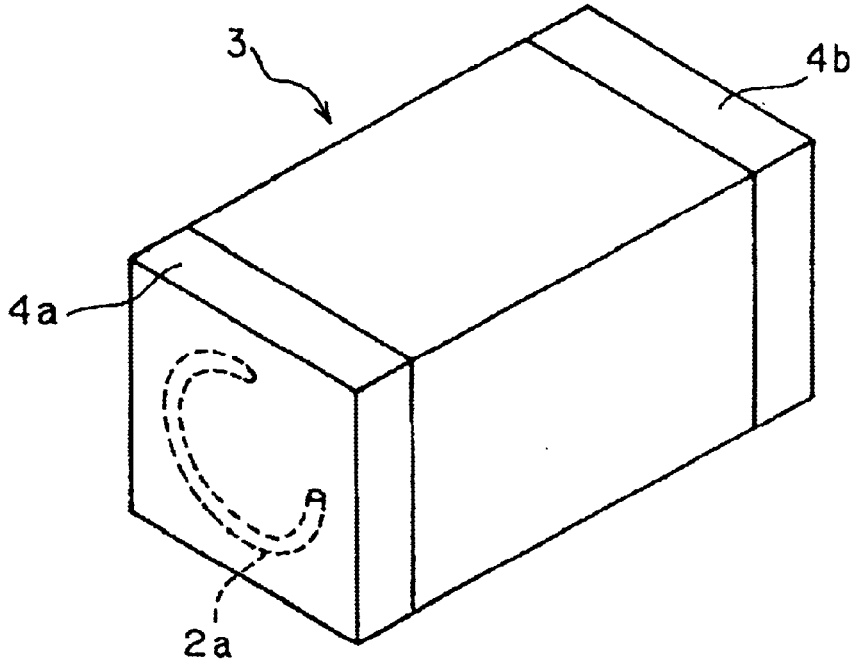
FIG. 5 is a perspective view showing the structure of an inductor produced by an inductor producing method in accordance with a preferred embodiment of the present invention.

FIG. 4 is a sectional view showing the construction of an inductor produced by an inductor producing method in accordance with a preferred embodiment of the present invention, and FIG. 5 is a perspective view showing the construction thereof.

Figure 1:
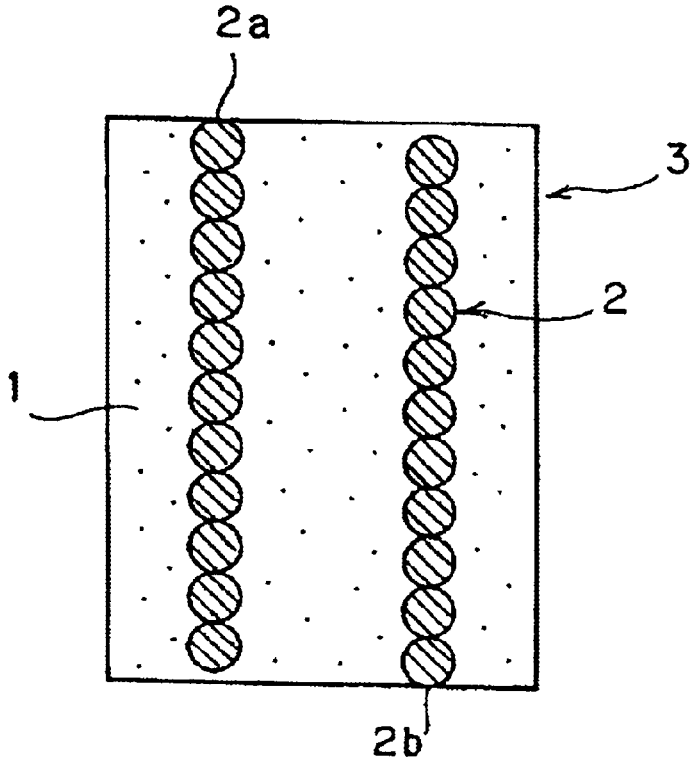
FIG. 1 is a sectional view showing a magnetic material compact body formed in a step of an inductor producing method in accordance with a preferred embodiment of the present invention.

As shown in FIG. 1, the inductor includes a magnetic material compact body 3 in which a coiled internal conductor (coil) 2 is provided in a magnetic material 1 formed by kneading a magnetic powder and a resin, and; a pair of external electrodes 4*a* and 4*b* (FIGS. 4 and 5) provided on both end surfaces of the magnetic material compact body 3 so as to be connected to the starting end 2*a* and the terminal end 2*b* of the coil 2.

In the inductor, the starting end 2*a* and the terminal end 2*b* of the coil 2 are exposed so that an approximately ¾ turn projects from both end surfaces of the magnetic material compact body 3, and the external electrodes 4*a* and 4*b* are disposed on both end surfaces of the magnetic material compact body 3 so as to be connected to the projecting portions of the starting end 2*a* and the terminal end 2*b*.

The external electrodes 4*a* and 4*b* are arranged to extend from both end surfaces of the magnetic material compact body 3.

In the inductor, the magnetic material compact body 3 preferably includes a magnetic material formed by kneading approximately 85 parts by weight of Ni—Cu—Zn ferrite (magnetic powder) and approximately 15 parts by weight of polyphenylene sulfide (PPS) (resin).

As the coil 2, a coiled copper wire (AIW wire) (diameter of about 0.5 mm) coated with polyamidoimide resin is preferably used. The coil 2 is preferably constructed of a metal material including Ag, Cu, Ni, and an alloy containing at least one of these metals, which have a low resistance value. Although, in this preferred embodiment, the coil 2 is used as the internal conductor, a conductor having a shape other than a coil shape, such as a plate or other suitable shape can be used as the internal conductor in some applications.

In the inductor of this preferred embodiment, the external electrodes 4*a* and 4*b* have a three-layer structure including Ni electroless plated layers (base layers) 14*a* and 14*b*, Ni electrolytic plated layers (intermediate layers) 24*a* and 24*b*, and Sn electrolytic plated layers (surface layers) 34*a* and 34*b*, respectively.

The method of producing the inductor will be described below.

The magnetic material formed by kneading approximately 85 parts by weight of Ni—Cu—Zn ferrite (magnetic powder) and approximately 15 parts by weight of polyphenylene sulfide (resin) is injection-molded, and polyphenylene sulfide (resin) is cured to produce the magnetic material compact body 3 in which the coil 2 formed by closely winding (pitch of each turn of the coil is contacted) the AIW wire having a diameter of about 0.5 mm is buried (FIG. 1). The method of forming the magnetic material compact body 3 in which the coil 2 is buried in the magnetic material 1 is not limited to injection molding, and other various known methods can be used.

As the method of curing the resin (PPS), various methods such as a method using a curing agent, a method of curing by heating the resin, and other suitable methods can be used.

Figure 2:
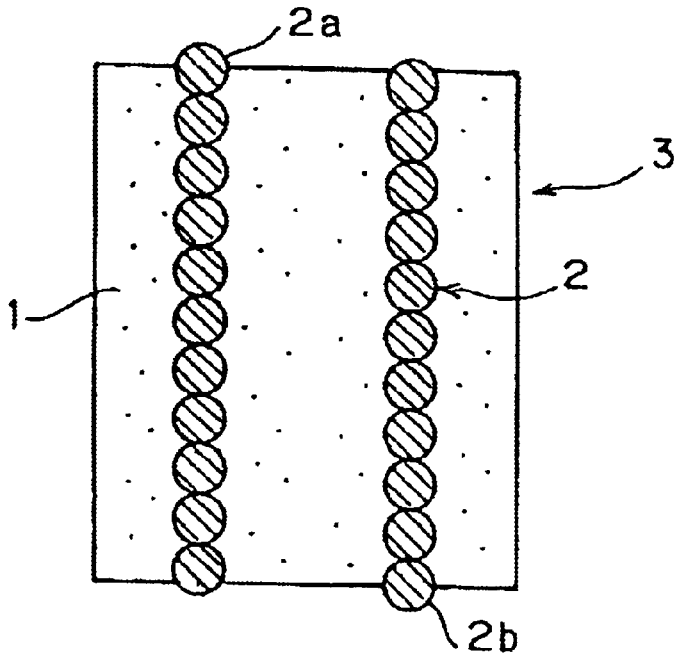
FIG. 2 is a sectional view showing a state in which both end surfaces of a magnetic material compact body formed in a step of an inductor producing method in accordance with a preferred embodiment of the present invention are roughened to partially expose an internal conductor (coil) from both end surfaces.
Figure 6:
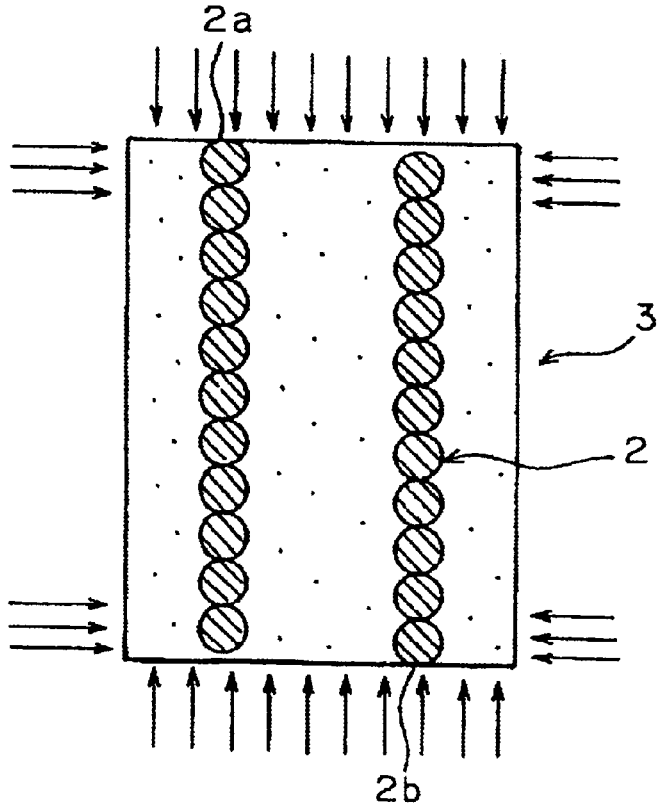
FIG. 6 is a drawing showing a state in which both end surfaces of a magnetic material compact body formed by an inductor producing method in accordance with a preferred embodiment of the present invention are roughened.
Figure 7:
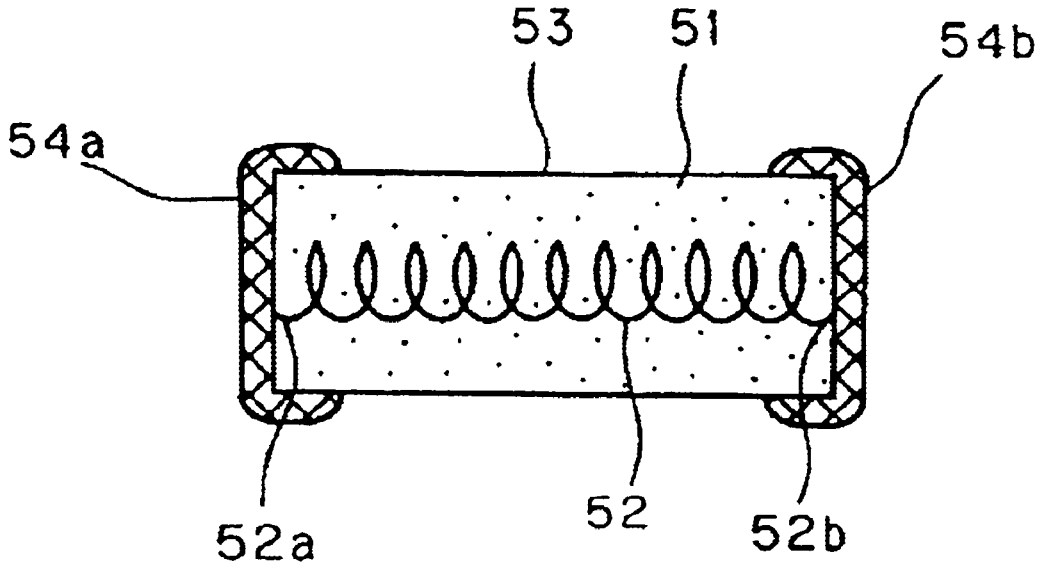
FIG.7 PRIOR ART
FIG. 7 is a sectional view showing an example of conventional inductors.
Figure 8:
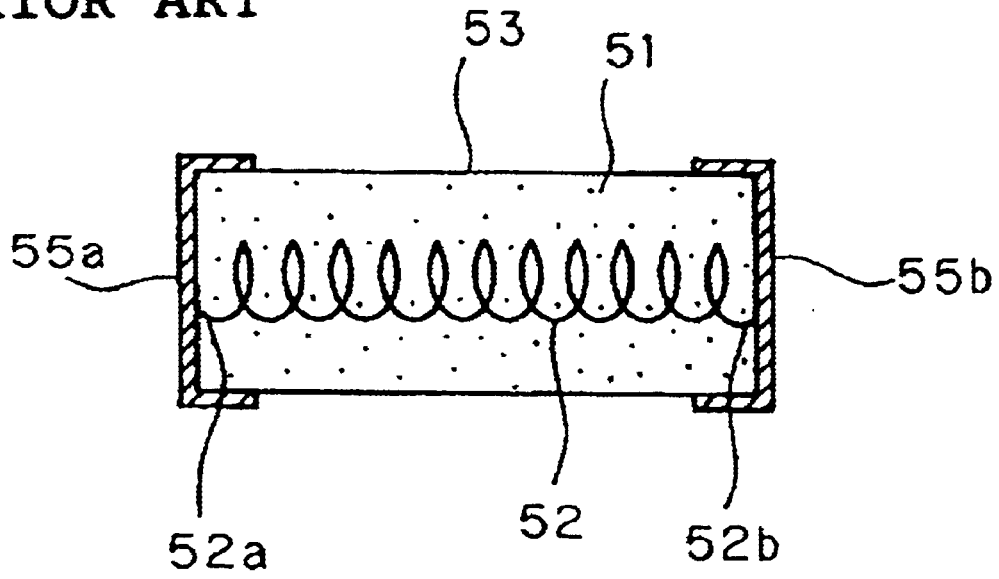
FIG.8 PRIOR ART
FIG. 8 is a sectional view showing another example of conventional inductors.

As schematically shown in FIG. 6, a region extending from either end surface of the magnetic material compact body 3 to a portion of the periphery (side) thereof is roughened by the method of spraying a surface roughening medium (powder and granules) (in this preferred embodiment, a sand blast method including spraying an alumina powder together with air is preferably used), and at the same time, an approximate ¾ turn of either end of the coil 2 is exposed from either end surface of the magnetic material compact body 3, while the insulating coating material on the surface of the coil 2 is removed (FIG. 2).

In surface roughening process, the end surfaces of the magnetic material compact body 3 are first roughened, and then the spray angle of the surface roughening medium is changed to roughen the periphery (side).

Figure 3:
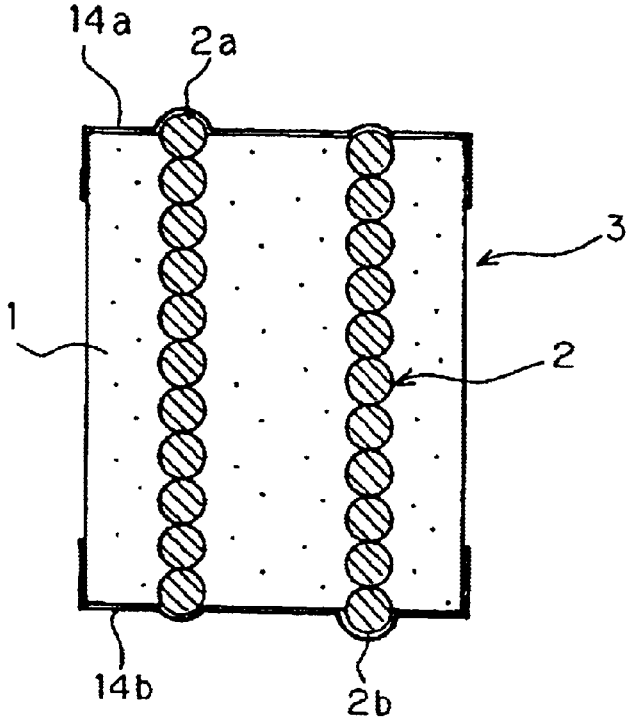
FIG. 3 is a sectional view showing a state in which base layers (Ni electroless plated layers) which constitute external electrodes are formed by electroless plating after roughening both end surfaces of a magnetic material compact body formed in a step of an inductor producing method in accordance with a preferred embodiment of the present invention.

Next, as shown in FIG. 3, the magnetic material compact body 3 is subjected to Ni electroless plating to provide the Ni electroless plated layers (base layers) 14*a* and 14*b* on the roughened portions of the magnetic material compact body 3.

For providing Ni electroless plated layers (base layers) 14*a* and 14*b* in a pattern including both end surfaces and the peripheral portions of the magnetic material compact, as shown in FIG. 3, various methods can be used, in which portions on which the Ni electroless plated layers (base layers) 14*a* and 14*b* are not provided are covered with a mask, or in which a Ni electroless plated layer (base layers) is provided over the entire surface of the magnetic material compact body 3 by electroless plating, and then unnecessary portions of the Ni plated layer are removed.

The Ni electrolytic plated layers (intermediate layers) 24*a* and 24*b* are provided over the Ni electroless plated layers (base layers) 14*a* and 14*b*, respectively, by Ni electrolytic plating, and in order to improve solderability, the Sn electrolytic plated layers (surface layers) 34*a* and 34*b* are further provided over the Ni electrolytic plated layers 24*a* and 24*b*, respectively, by Sn electrolytic plating. Thereby, the three-layer structure external electrodes 4*a* and 4*b* is provided.

As a result, the inductor shown in FIGS. 4 and 5 is constructed.

In the inductor produced as described above, the coil 2 is used as the internal conductor, and the starting end 2*a* and the terminal end 2*b* are exposed to project from both end surfaces of the magnetic material compact body 3 so that the external electrodes 4*a* and 4*b* are provided and connected to the projecting starting end 2*a* and terminal end 2*b*. Therefore, it is possible to keep the electric resistance of the coil (internal conductor) 2 low to achieve the desired characteristics, and ensure a sufficient area of contact between the coil (internal conductor) 2 and: the external electrodes 4*a* and 4*b* to significantly improve connection reliability.

In the method of producing the inductor of this preferred embodiment, the magnetic material compact body 3 is preferably formed by injection-molding a magnetic material and curing the resin, and the external electrodes 4*a* and 4*b* are provided by plating, thereby eliminating the need for firing in the step of forming the magnetic material compact, and baking conductive paste in the step of forming the external electrodes. Thus, the occurrence of decomposition or deterioration of the magnetic material in the heat treatment step is avoided, and an inductor having desired characteristics is efficiently produced. Also, equipment such as a heat treatment furnace, and thermal energy used for heat treatment is unnecessary, thus decreasing production cost.

Since the surface of the magnetic material compact body 3 is roughened before plating to expose the ends 2*a* and 2*b* of the coil 2 so that the ends are projected from both end surfaces of the magnetic material compact body 3, the strength of adhesion of the external electrodes (plated metal film) 4*a* and 4*b* to the magnetic material compact body 3 is substantially improved, and the area of contact with the external electrodes 4*a* and 4*b* is substantially increased, thereby improving the reliability of connection between the external electrodes 4*a* and 4*b* and the coil 2. Also, surface roughening is performed in a region extending from either end surface of the magnetic material compact body 3 to a portion of the periphery thereof so that the external electrodes 4*a* and 4*b* are provided on the roughened regions of the surface, thereby improving the strength of adhesion of the external electrodes (plated metal film) 4*a* and 4*b* to the magnetic material compact body 3.

Although, in the above-described preferred embodiment, surface roughening is performed by the sand blasting method as an example, various methods of spraying a surface roughening medium (powder and granules), for example, the wet blast method or other suitable methods in which an alumina powder or silica powder is sprayed together with a liquid such as water to grind the surface of the magnetic material compact, can also be used.

In this preferred embodiment, the external electrodes 4*a* and 4*b* have a three-layer structure including the Ni electroless plated layers (base layers) 14*a* and 14*b*, the Ni electrolytic plated layers (intermediate layers) 24*a* and 24*b*, and the Sn electrolytic plated layers (surface layers) 34a and 34*b*, respectively. However, the structure of the external electrodes 4*a* and 4*b* is not limited, and various applications and modifications can be made in which a single-layer or multi-layer structures is used, and the number of layers and combinations of layers in the multi-layer structure can be varied.

As the plating method for forming the external electrodes, various known plating methods such as the electrolytic plating method, the electroless plating method, and other suitable plating methods can be used.

The present invention is not limited to the above-described embodiment in other respects, and various applications and modifications can be made in the scope of the invention.

As described above, the method of producing an inductor of the present invention includes molding a magnetic material formed by kneading a magnetic powder and a resin into a desired shape, to form a magnetic material compact body in which an internal conductor is partially exposed from the surface, and forming external electrodes on the surface by plating so that the external electrodes are connected to the internal conductor. Therefore, heat treatment for burning in the step of forming the magnetic material compact, and heat treatment for baking conductive paste in the step of forming the external electrodes are unnecessary, thereby avoiding the occurrence of decomposition or deterioration of the magnetic material in the heat treatment steps to efficiently produce an inductor having desired characteristics. Also, equipment such as a heat treatment furnace, heat energy used for heat treatment, and costly resources are unnecessary, thereby substantially reducing production cost.

In the method of producing an inductor, portions of the surface of the magnetic material compact, which are plated, are roughened before plating, thereby improving the strength of adhesion of the plated metal films to the magnetic material compact body to improve reliability.

In the method of producing an inductor, both ends of the internal conductor are exposed from both end surfaces of the magnetic material compact, and at least both end surfaces are roughened so that at least portions of the roughened surfaces are plated to form the external electrodes. In this case, the external electrodes are provided on both end sides of the magnetic material compact body (element) to efficiently produce a chip type inductor having excellent applicability for surface mounting, thereby further extending the present invention's effectiveness.

In the method of producing an inductor, with the internal conductor including a coiled metal conductor (coil), approximately ⅓ to 1 turn of the coil is partially exposed by surface roughening to project from both end surfaces of the magnetic material compact, and then the external electrodes are formed by plating, thereby ensuring a sufficient area of contact between the coil and the external electrodes to significantly improve the reliability of connection therebetween.

In the method of producing an inductor, surface roughening is performed in a region extending from either end surface of the magnetic material compact body to a portion of the outer periphery thereof, and then the external electrode is formed to extend from either end surface of the magnetic material compact body to the portion of the periphery thereof. In this case, for example, in mounting by a reflow soldering method, the workability of mounting is greatly improved so as to improve the reliability of connection (mounting).

In the method of producing an inductor, the surface of the magnetic material compact body is roughened by the method of spraying a surface roughening medium (powder and granules), for example, the dry blast method (sand blast method) in which a medium such as an alumina powder, a silica powder, or other suitable material is sprayed together with air to grind the surface of the magnetic material compact, or the wet blast method in which a medium such as an alumina powder, a silica powder, or other suitable material is sprayed together with a liquid such as water to grind the surface of the magnetic material compact. In this case, surface roughening can be efficiently performed within a short time, further improving the present invention's effectiveness.

In the present invention, the structure and type of the plated metal film that constitutes the external electrodes is not particularly limited, and a single structure (single layer structure) may be used. However, in the method of producing an inductor, the external electrodes having a multilayer structure improves the solderability of the external electrodes, and the reliability of electric connection.

The inductor produced by the inductor producing method according to preferred embodiments of the present invention has the above-described construction and high reliability of connection between the external electrodes and the internal conductor, and is efficiently produced at low cost.

It should be understood that the foregoing description is only illustrative of the present invention. Various alternatives and modifications can be devised by those skilled in the art without departing from the invention. Accordingly, the present invention is intended to embrace all such alternatives, modifications and variations which fall within the scope of the appended claims.

What is claimed is:

1. A method of producing an inductor comprising the steps of;

molding a magnetic material formed by kneading a magnetic powder and a resin into a desired shape in which an internal conductor functioning as an inductance element is buried, to form a magnetic material compact body in which the internal conductor is partially exposed at a surface thereof;

exposing both ends of the internal conductor at both end surfaces of the magnetic material compact body;

roughening at least said both end surfaces of the magnetic material compact body; and plating at least a portion of the roughened surfaces to form external electrodes thereon including a plated metal film which is electrically connected to said both ends of the internal conductor which are exposed at said both end surfaces of the magnetic material compact body; wherein the internal conductor comprises a coiled metal conductor, and said both end surfaces of the magnetic material compact body are roughened in the roughening step to expose an approximately ⅓ to 1 turn of the coiled metal conductor such that the coiled metal conductor partially projects from said both end surfaces of the magnetic material compact, and then at least a portion of the roughened surfaces is plated to form the external electrode in said plating step.

2. The method of producing an inductor according to claim 1, wherein the step of roughening at least said both end surfaces of the magnetic material compact body is accomplished by a medium spraying method of spraying a surface roughening medium.

3. The method of producing an inductor according to claim 2, wherein the medium spraying method is a dry method using air.

4. The method of producing an inductor according to claim 2, wherein the medium spraying method is a wet method using water.

5. The method of producing an inductor according to claim 1, wherein the external electrodes have a multilayer structure comprising a plurality of plated metal films.

6. A method of producing an inductor comprising steps of:

molding a magnetic material formed by kneading a magnetic powder and a resin into a desired shape in which an internal conductor functioning as an inductance element is buried, to form a magnetic material compact body in which the internal conductor is partially exposed at both end surfaces thereof;

roughening at least said both end surfaces so as to expose the internal conductor from said both end surfaces; and plating said both end surfaces of the magnetic material compact body to form an external electrode including a plated metal film and electrically connected to a portion of the internal conductor which is exposed at said both end surfaces of the magnetic material compact body; and roughening a region extending from either of said end surfaces of the magnetic material compact body to a portion at either end of a peripheral surface, and then forming the external electrode by plating so that the external electrode extends from said either of said end surfaces of the magnetic material compact body to the portion of the peripheral surface thereof In said plating step.

7. The method of producing an inductor according to claim 6, wherein said both end surfaces of the magnetic material compact body are roughened by a medium spraying method of spraying a surface roughening medium.

8. The method of producing an inductor according to claim 7, wherein the medium spraying method is a dry method using air.

9. The method of producing an inductor according to claim 7, wherein the medium spraying method is a wet method using water.

10. The method of producing an inductor according to claim 6, wherein the external electrode has a multilayer structure comprising a plurality of plated metal films.

11. A method of producing an inductor comprising the steps of:

molding a magnetic material formed by kneading a magnetic powder and a resin into a desired shape in which an internal conductor functioning as an inductance element is buried, to form a magnetic material compact body in which the internal conductor is partially exposed at a surface thereof;

exposing both ends of the internal conductor at both end surfaces of the magnetic material compact body;

roughening at least said both end surfaces of the magnetic material compact body; and plating at least a portion of the roughened surfaces to form external electrodes thereon including a plated metal film which is electrically connected to said both ends of the internal conductor which are exposed at said both end surfaces of the magnetic material compact body; wherein said roughening step includes roughening a region extending from either of said both end surfaces of the magnetic material compact body to a portion of a peripheral surface, and then forming the external electrode by plating so that the external electrode extends from said either of said both end surfaces of the magnetic material compact body to the portion of the peripheral surface thereof in said plating step.

12. The method of producing an inductor according to claim 11, wherein the step of roughening at least said both end surfaces of the magnetic material compact body is accomplished by a medium spraying method of spraying a surface roughening medium.

13. The method of producing an inductor according to claim 12, wherein the medium spraying method is a dry method using air.

14. The method of producing an inductor according to claim 12, wherein the medium spraying method is a wet method using water.

15. The method of producing an inductor according to claim 11, wherein the external electrodes have a multilayer structure comprising a plurality of plated metal films.

* * * * *